US005102247A

United States Patent [19]

Nagoshi et al.

[11] Patent Number: 5,102,247

[45] Date of Patent: Apr. 7, 1992

[54] SHEET CONVEYING DEVICE

[75] Inventors: Shigeyasu Nagoshi, Tokyo; Shigeru Okamura, Kawasaki, both of Japan

[73] Assignee: Canon Kabushiki Kaisha, Tokyo, Japan

[21] Appl. No.: 532,228

[22] Filed: Jun. 5, 1990

Related U.S. Application Data

[63] Continuation of Ser. No. 374,610, Jul. 5, 1989, abandoned, which is a continuation of Ser. No. 172,952, Mar. 25, 1988, abandoned, which is a continuation of Ser. No. 820,747, Jan. 22, 1986, abandoned.

[30] Foreign Application Priority Data

Jan. 30, 1985 [JP] Japan ..... 60-14472

[51] Int. Cl.[5] ..... B41J 13/14

[52] U.S. Cl. ..... 400/642; 400/126; 346/138

[58] Field of Search ..... 400/126, 578, 634, 636.2, 400/643, 645, 645.1, 645.2, 645.3, 645.4, 645.5, 642; 226/168, 188, 198; 346/138

[56] References Cited

U.S. PATENT DOCUMENTS

| | | | |
|---|---|---|---|
| 2,664,988 | 1/1954 | Metzner | 400/636.2 X |
| 4,268,021 | 5/1981 | Rutishauser et al. | 400/636.2 X |
| 4,294,556 | 10/1981 | Rix | 400/126 X |

FOREIGN PATENT DOCUMENTS

| | | | |
|---|---|---|---|
| 791439 | 12/1935 | France | 400/645.5 |
| 72517 | 6/1978 | Japan . | |
| 56891 | 5/1981 | Japan | 400/126 |

*Primary Examiner*—David A. Wiecking
*Attorney, Agent, or Firm*—Fitzpatrick, Cella, Harper & Scinto

[57] ABSTRACT

This specification discloses a sheet conveying device for conveying a sheet which is applied to an image recording apparatus. More particularly, the specification discloses a sheet conveying device for conveying a sheet by the cooperation between a rotational member rotatable in the direction of sheet conveyance and a contact member which is in contact with the rotational member. According to the present invention, there is provided a sheet conveying device which can convey a sheet without causing oblique movement and irregularity of feeding of the sheet, for example, even under high temperature and high humidity conditions.

14 Claims, 4 Drawing Sheets

SHEET CONVEYING DEVICE

This application is a continuation of application Ser. No. 374,610, filed July 5, 1989, now abandoned, which is a continuation of Ser. No. 172,952, filed Mar. 25, 1988, now abandoned, which is a continuation of Ser. No. 820,747, filed Jan. 22, 1986, now abandoned.

BACKGROUND OF THE INVENTION

1. Field of the Invention

This invention relates to a sheet conveying device used in an image recording apparatus such as a printer, an ink jet printer, an electronic typewriter, a facsimile apparatus or an electrophotographic copying apparatus to reliably convey, for example, a recording sheet or the like on which an image is recorded.

2. Description of the Prior Art

A sheet conveying device is known which conveys a recording sheet to a recording station in which a recording head or the like is provided by the cooperation between a rotational member rotatable in the direction of sheet conveyance and a keep plate urged against the rotational member in order to effect image recording on the recording sheet. However, in the above-described sheet conveying device of the known structure, if an attempt is made to convey, for example, a transparent plastic sheet for an overhead projector (hereinafter referred to as the OHP sheet) under high temperature and high humidity conditions, the OHP sheet comes into intimate contact with the keep plate due to the humidity, and this had led to an undesirable possibility that normal conveyance cannot be accomplished.

SUMMARY OF THE INVENTION

It is an object of the present invention to provide a sheet conveying device which can more reliably accomplish the conveyance of sheets.

It is another object of the present invention to provide a sheet conveying device which can reliably accomplish the conveyance of sheets without causing jamming thereof even under high temperature and high humidity conditions.

It is still another object of the present invention to provide a sheet conveying device which can also reliably convey, for example, other sheets than OHP sheets.

It is yet still another object of the present invention to provide a recording apparatus provided with a sheet conveying device which achieves the above objects.

The sheet conveying device of the present invention has a rotational member rotatable in the direction of sheet conveyance, a contact member provided in contact with the peripheral surface of said rotational member to cooperate with said rotational member to convey a sheet, and a plurality of protruded portions provided on said contact member projecting toward said rotational member.

Further, the sheet conveying device of the present invention has a sheet feeding roller rotatively driven to convey a sheet, a pinch roller disposed in contact with said sheet feeding roller and following the rotation of said sheet feeding roller, a platen roller provided downstream of said rollers and rotatively driven to convey the sheet, a keep plate provided in pressure contact with the peripheral surface of said platen roller to feed the sheet while nipping the sheet between it and said platen roller, and a plurality of projections provided on said keep plate projecting toward the side opposed to said platen roller, said keep plate and said projections each having a frictional load reducing coating on the surface thereof opposed to the sheet.

An ink jet printer provided with the sheet conveying means of the present invention has a rotational member rotatable in the direction of sheet conveyance, a contact member provided in contact with the peripheral surface of said rotational member to cooperate with said rotational member to convey a sheet, a plurality of protruded portions provided on said contact member projectedly toward said rotational member, and recording means provided downstream of the position of contact between said rotational member and said contact member with respect to the direction of sheet conveyance to inject ink in response of image information and form an image on the sheet.

DESCRIPTION OF THE PREFERRED EMBODIMENTS

The present invention will hereinafter be described in greater detail with respect to some embodiments thereof.

Figure 1:
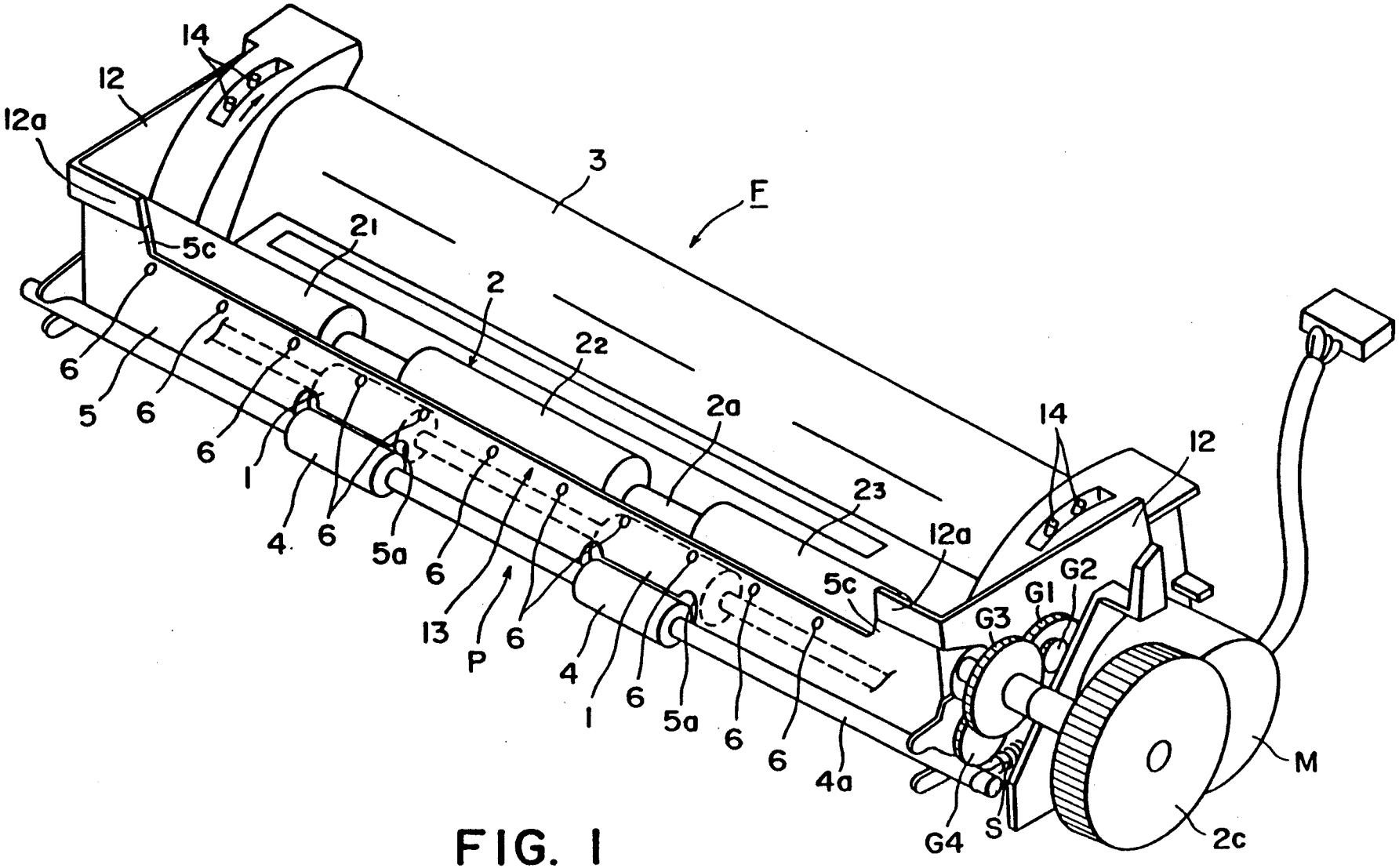
FIG. 1 is a perspective view of a sheet conveying device to which an embodiment of the present invention is applied.
Figure 2A:
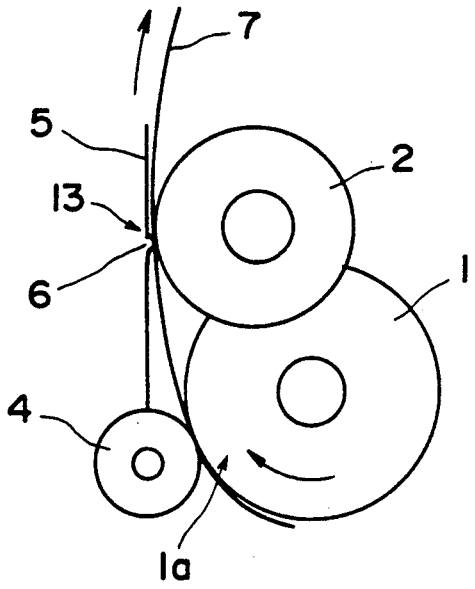
FIG. 2*a* is a left side view showing the essential portions of the device of FIG. 1.
Figure 2B:
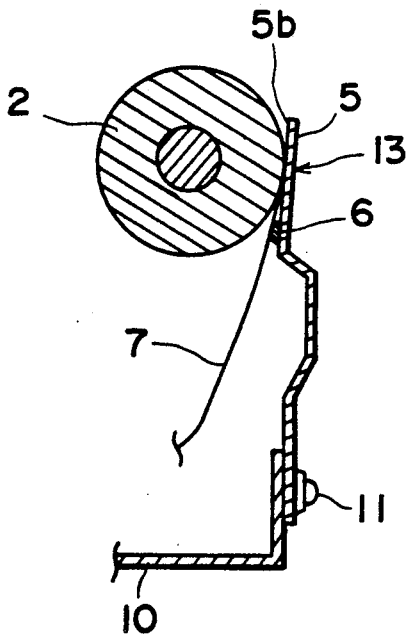
FIG. 2*b* is a partial cross-sectional view of a keep plate.
Figure 3A:
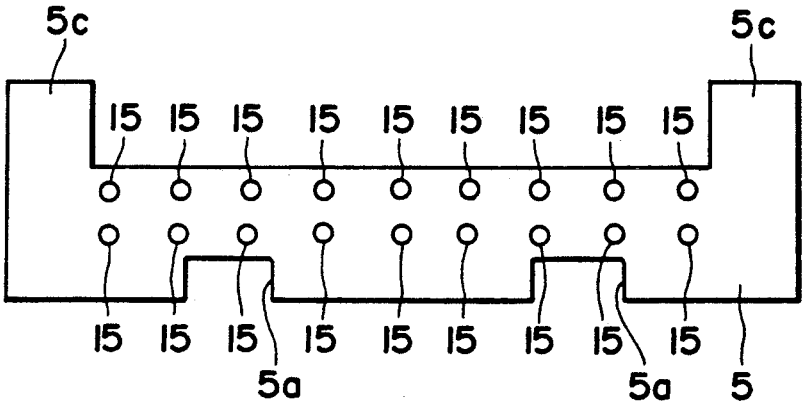
FIG. 3*a* is a plan view of the keep plate.
Figure 3B:
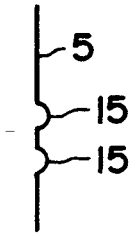
FIG. 3*b* is a side view of the keep plate.
Figure 4A:
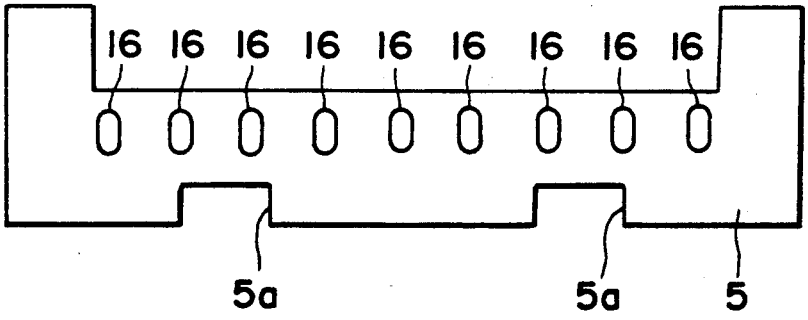
FIG. 4*a* is a plan view of another embodiment of the keep plate.
Figure 4B:
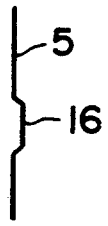
FIG. 4*b* is a side view of said another embodiment.
Figure 5:
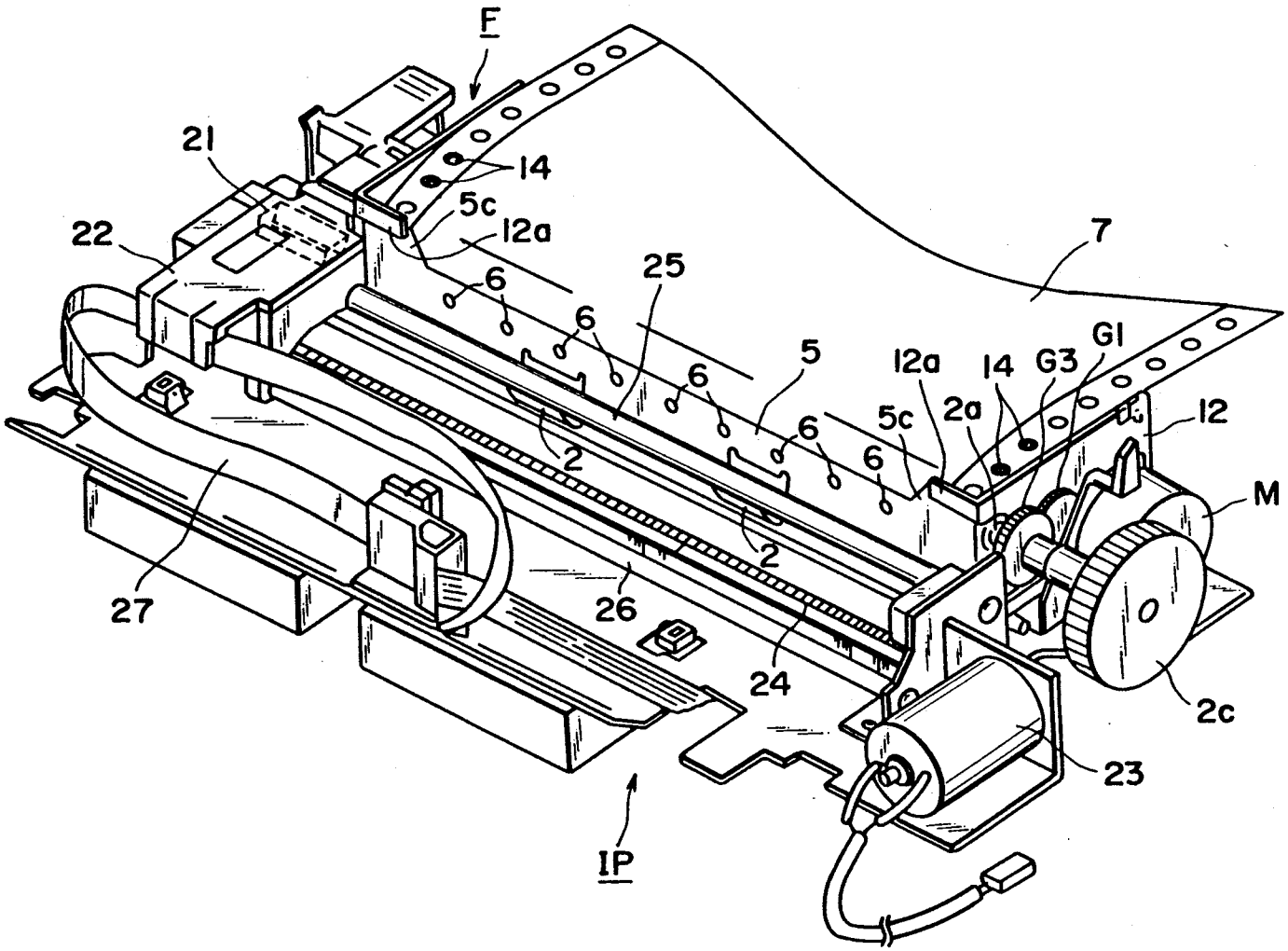
FIG. 5 is a perspective view of an ink jet printer provided with the sheet conveying device shown in FIG. 1.

FIG. 1 is a perspective view of a sheet conveying device F to which an embodiment of the present invention is applied, FIG. 2*a* is a left side view showing the essential portions thereof, FIG. 2*b* is a partial cross-sectional view of a keep plate thereof, FIG. 3*a* is a plan view of the keep plate, FIG. 3*b* is a side view thereof, FIG. 4*a* is a plan view of another embodiment of the keep plate, FIG. 4*b* is a side view thereof, and FIG. 5 is a perspective view of an ink jet printer IP provided with the sheet conveying device F shown in FIG. 1.

The sheet conveying device F to which an embodiment of the present invention is applied will first be described with reference to FIGS. 1 2*a* and 2*b*.

In FIGS. 1, 2*a* and 2*b*, reference numeral 1 designates a drive paper feeding roller which cooperates with a pinch roller 4 (which will later be described in detail) to convey a recording sheet 7 toward a driving platen 2 while guiding the recording sheet 7 along the peripheral surface 1*a* thereof. The platen 2 comprises rubber rollers $2_1$, $2_2$ and $2_3$ secured to a shaft 2*a* at predetermined intervals. The platen 2 may be a full width roller provided over the full width of a recording sheet conveying path P or may be a fixed member or the like.

A paper keep plate 5 is installed on the peripheral surface of the platen 2 over the full length thereof along the recording sheet conveying path P. This paper keep plate 5 is formed of a resilient metallic or plastic plate, and has its lower end secured to the frame member 10 of the device by screws 11 so as to press against the platen 2 with predetermined pressure (FIG. 2*b*). The left and right ends of the keep plate 5 extend upwardly, and these upwardly extending portions 5*c* are along the bent portions 12*a* of the frame member 12 of the device. In the present embodiment, a plurality of projections 6 are provided on that side 5*b* of the paper keep plate 5 which is opposed to the platen roller 2 and slightly below the portion of contact 13 between the roller 2 and the keep plate 5 (or upstream with respect to the direction of recording sheet conveyance). These projections 6 project circularly toward the platen 2 and are arranged on the keep plate 5 in a row at predetermined intervals over the full width of the recording sheet conveying path P. Accordingly, the area of contact between the paper keep plate 5 and the conveyed recording sheet 7 decreases remarkably as compared with the paper keep plate of conventional structure, and the friction force which the recording sheet 7 receives from the paper keep plate also decreases remarkably.

A paper guide 3 (formed of a rigid material such as a metal or plastic) for guiding the recording sheet is disposed behind the platen 2 and the fore end portion thereof is along the peripheral surface of the paper feeding roller 1.

A plurality of cut-away portions 5*a* are formed in the lower portion of the paper keep plate 5, and the pinch roller 4 rotatably supported on a shaft 4*a* parallel to the platen 2 fits in these cut-away portions 5*a*. The pinch roller 4 is biased by a spring S so as to contact the paper feeding roller 1 with predetermined pressure and follows the rotation of the platen 2.

Driving of the platen rollers 21, 22 and 23 and the paper feeding roller 1 will now be described.

In the present embodiment, the recording sheet can also be manually fed by turning a platen knob 2*c* provided on one end of the shaft 2*a* of the platen 2. Alternatively, the recording sheet can be automatically fed by the use of a motor M or the like. Where automatic feeding is to be effected, a drive starting signal produced by a button (not shown) being depressed is received by the motor M, whereupon the motor M starts driving. The rotational force of this motor M is transmitted to gears G1, G2 and G3 through a motor shaft (not shown), and the platen rollers $2_1$, $2_2$ and $2_3$ start rotating. At the same time, the rotational force of the motor M is transmitted from the gear G1 to a gear G4 through a gear, not shown, whereby the paper feeding roller 1 starts rotating.

Description will now be made of the conveyance of the recording sheet by the sheet conveying device F of the above-described construction.

Description will first be made of a case where the recording sheet is long fan-fold paper. However, of course, even a cut sheet can be conveyed in the present device.

The recording sheet 7 advanced along the peripheral surface 1*a* of the paper feeding roller 1 is nipped and conveyed between and by the paper feeding roller 1 and the pinch roller 4 and travels toward the platen rollers $2_1$, $2_2$ and $2_3$ disposed above the rollers 1 and 4. Hereupon, the advanced recording sheet 7 bears against the projections 6 and comes to the portion of pressure contact 13 between the platen rollers $2_1$, $2_2$, $2_3$ and the keep plate 5 in a state in which it is not in intimate contact with the planar portion of the keep plate 5, and receives the conveying force with the aid of the platen rollers $2_1$, $2_2$, $2_3$ and travels toward the guide 3. The recording sheet 7 having arrived at the guide 3 receives the conveying force by the openings at the opposite ends thereof being engaged with drive pins 14 secured to drive belts (not shown) provided on the opposite ends of the guide 3, and is discharged thereby.

Another embodiment of the projections provided on the keep plate 5 will now be described with reference to FIGS. 3*a* and 3*b* and FIGS. 4*a* and 4*b*.

FIGS. 3*a* and 3*b* illustrate a second embodiment of the present invention. In the present embodiment, circular projections 15 are formed at two upper and lower stages on the paper keep plate 5. If the area of protrusion of the circular projections 15 is made smaller than the area of protrusion in the above-described first embodiment, the area of contact between the projections 15 and the recording sheet will not increase. Moreover, the projections 15 are provided at two stages and therefore, the recording sheet can be caused to feed up more reliably from the keep plate 5.

FIGS. 4*a* and 4*b* illustrate a third embodiment of the present invention. In the present embodiment, elliptical projections 16 having their major axis in the direction of paper feeding are formed on the paper keep plate 5.

If such a structure is adopted, an effect similar to that of the previously described embodiment is obtained and in addition, irregularity of feeding in a direction perpendicular to the direction of paper feeding can be prevented because the projections 16 are elongated with respect to the direction of paper feeding.

Now, in the above-described first, second and third embodiments, projections are merely formed on the paper keep plate, but with the formation of the projections, that side of the paper keep plate which contacts the recording sheet may be coated with a material of small friction force. In this manner, the friction force between the recording sheet and the paper keep plate can be decreased and smooth paper feeding can be accomplished.

An ink jet printer IP to which the paper feeding device F according to the first embodiment is applied will now be described with reference to FIG. 5.

In FIG. 5, reference numeral 21 designates a printing head having a plurality of nozzles (not shown) for ejecting ink therethrough in response to image information. This printing head 21 is mounted on a carriage 22 which is reciprocally moved along the recording sheet 7 by a motor 23 through a belt 24. Reference numerals 25 and 26 denote guide bars for guiding the reciprocally movable carriage 22.

Accordingly, in this ink jet printer IP, the ink image is recorded on the recording sheet 7 positively conveyed by the first embodiment, by the printing head 21, after the recording sheet has passed the portion of contact 13 between the platen rollers $2_1$, $2_2$, $2_3$ and the keep plate 5. At this time, the carriage 22 is moved to the right from its home position (shown in FIG. 5) to thereby effect image recording, whereafter it is returned to its home position to thereby effect the recording of the image of the next line. Reference numeral 27 designates a transmission path for transmitting an image information signal to the recording head 21. The recording sheet 7 on which image recording has been effected is discharged by the aforedescribed paper feeding device F.

Here, the result of an OHP sheet (a cut sheet of size A4) having been conveyed by the use of the ink jet printer shown in FIG. 5 is shown. The OHP sheet used in this experiment is coated with a special chemical agent to ensure the fixation of ink and quicken the drying of ink.

Now, in the present device, the thickness of the keep plate 5 is about 0.15 mm, the height of each projection 6 is about 0.15 mm and twenty projections 6 are arranged in a row at intervals of about 11 mm. The surfaces of the keep plate 5 and the projections 6 which contact the OHP sheet are coated with a solid coating lubricant called fluorine resin Drilube (manufactured under the trade name of S-1215 by Toyo Drilube Co., Ltd.). When the OHP sheet was conveyed by this device, the OHP sheet could be reliably conveyed without jamming while image recording was effected even if the room temperature was about 33° C. and the humidity was about 80%.

As described above, the present invention can provide a sheet conveying device in which oblique movement and irregularity of feeding of the recording sheet do not occur even under high temperature and high humidity conditions.

We claim:

1. A printer provided with a sheet conveying device for conveying a recording sheet to be recorded, said printer comprising:

a rotary member rotatable in a sheet conveying direction of the recording sheet to convey the recording sheet;

a press member for biasing a peripheral surface of said rotary member to cooperate with said rotary member and convey the recording sheet;

recording means for recording onto the recording sheet downstream of a contacting position between said rotary member and said pressing member with respect to the sheet conveying direction; and a protruded portion provided at a surface of said pressing member and protruding therefrom, with said protruded portion being disposed upstream of the contact position with respect to the sheet conveying direction;

wherein said protruded portion contacts the sheet upstream of said contact position to keep the sheet apart from said contact surface upstream of said contact position and said protruded portion is not in pressure contacting relation with said rotary member.

2. A sheet conveying device for conveying a sheet, said device comprising:

a rotatable rotary member;

a contact member in contactable relation with said rotary member at a contact position to cooperate with said rotary member and convey the sheet in a sheet conveying direction; and a protruded portion provided at a surface of said contacting member and protruding therefrom, with said protruded portion being disposed upstream of the contact position with respect to the sheet conveying direction, wherein said protruding portion contacts the sheet upstream of said contact position to keep the sheet apart from said contact member upstream of said contact position and said protruded portion is not in pressure contacting relation with said rotary member.

3. A sheet conveying device for conveying a sheet, comprising:

a rotational member rotatable in a direction of sheet conveyance;

a contact member provided with a contact surface in contactable relation with a peripheral surface of said rotational member at a contact position, cooperating with said rotational member to convey the sheet; and a protruded member protruded from said contact member upstream of the contact position and having a contoured surface projecting toward said rotational member, wherein said protruded member contacts the sheet upstream of said contact position to keep the sheet apart from the contact surface upstream of said contact position and said protruded member is not in pressure contacting relation with said rotational member.

4. A sheet conveying device according to claim 3, wherein a plurality of said protruded members are provided at intervals over the full width of a sheet conveying path.

5. A sheet conveying device according to claim 3, wherein said contact member is urged against the peripheral surface of said rotational member.

6. A device according to claim 3, wherein said protruded member is elongated relative to the sheet conveyance direction.

7. A device according to claim 3, wherein a plurality of protruded members are arranged in one row which has protruded members provided at intervals over the full width of a sheet conveyance path.

8. A sheet conveying device according to claim 3, wherein the surface of said protruded member which is opposed to the sheet is provided with a frictional load reducing coating.

9. A sheet conveying device for conveying a sheet, comprising:

a sheet feeding roller rotatively driven to convey the sheet;

a pinch roller disposed in contact with said sheet feeding roller and following the rotation of said sheet feeding roller;

a platen roller provided downstream of said sheet feeding roller and said pinch roller and rotatively driven to convey the sheet;

a keep plate having a contact surface provided in pressure contactable relation with a peripheral surface of said platen roller at a contact position, for feeding the sheet while nipping the sheet between said keep plate and said platen roller; and a projection protruded from said keep plate upstream of the contact position, said projection having a contoured surface projecting toward said platen roller, wherein said projection contacts the sheet upstream of said contact position to keep the sheet apart from the contact surface upstream of said contact position and said projection is not in pressure contacting relation with said platen roller.

10. A printer provided with a sheet conveying device for conveying a recording sheet on which an image is recorded, said printer comprising:

a rotational member rotatable in a direction of sheet conveyance to convey the recording sheet;

a keep plate having a contact surface provided in pressure contactable relation with a peripheral surface of said rotational member at a contact position, for cooperating with said rotational member to convey the recording sheet;

a protruded member protruded from said keep plate upstream of the contact position between said rotational member and said keep plate and having a contoured surface projecting toward said rotational member; and recording means provided downstream of the contact position for forming an image on the recording sheet;

wherein said protruded member contacts the sheet upstream of said contact position to keep the sheet apart from the contact surface upstream of said contact position and said protruded member is not in pressure contacting relation with said rotational member.

11. A printer according to claim 10, wherein a plurality of said protruded members are provided at intervals over the full width of a sheet conveying path.

12. A printer according to claim 3, wherein said protruded member is elongated relative to the sheet conveyance direction.

13. A printer according to claim 10, wherein a plurality of protruded members are arranged in one row which has protruded members provided at intervals over the full width of a sheet conveying path.

14. A printer according to claim 10, wherein the surface of said protruded member which is opposed to the sheet is provided with a frictional load reducing coating.

* * * * *

UNITED STATES PATENT AND TRADEMARK OFFICE

CERTIFICATE OF CORRECTION

PATENT NO. : 5,102,247

DATED : April 7, 1992

INVENTOR(S) : SHIGEYASU NAGOSHI, ET AL.

It is certified that error appears in the above-identified patent and that said Letters Patent is hereby corrected as shown below:

COLUMN 2

Line 53, "FIGS. 1 2a" should read --FIGS. 1, 2a--.

COLUMN 3

Line 33, "platen rollers 21, 22 and 23" should read --platen rollers $2_1$, $2_2$, and $2_3$--.

COLUMN 8

Line 4, "claim 3," should read --claim 10,--.

Signed and Sealed this

Eleventh Day of January, 1994

*Attest:*

Bruce Lehman

BRUCE LEHMAN

*Attesting Officer*

*Commissioner of Patents and Trademarks*